United States Patent [19]

Poehlmann

[11] 4,454,971

[45] Jun. 19, 1984

[54] PROJECTILE MAGAZINE

[76] Inventor: Paul W. Poehlmann, P.O. Box 487, Stinson Beach, Calif. 94970

[21] Appl. No.: 406,365

[22] Filed: Aug. 9, 1982

[51] Int. Cl.[3] ..... B65D 83/04

[52] U.S. Cl. ..... 224/196; 206/533

[58] Field of Search ..... 224/196, 219; 221/79, 221/80, 82, 185; 206/533

[56] References Cited

U.S. PATENT DOCUMENTS

| | | | |
|---|---|---|---|
| 1,384,145 | 7/1921 | Monlon | 224/196 |
| 1,904,730 | 4/1933 | Harrington | 42/59 |
| 3,085,679 | 4/1963 | Burrell | 206/533 |
| 3,414,161 | 12/1968 | Doring | 221/80 |
| 4,078,661 | 3/1978 | Thomas | 206/533 |
| 4,307,734 | 12/1981 | Blankenship | 206/533 |

FOREIGN PATENT DOCUMENTS

| | | | |
|---|---|---|---|
| 485832 | 8/1952 | Canada | 224/196 |

*Primary Examiner*—Steven M. Pollard
*Assistant Examiner*—David Voorhees
*Attorney, Agent, or Firm*—Lothrop & West

[57] ABSTRACT

A wrist band holds a base containing a rotor having bores effective to hold pellets. Upon manual rotating of the periphery of the rotor relative to the base, the pellets are lifted or partially ejected for easy individual grasping by the user.

7 Claims, 15 Drawing Figures

FIG-4
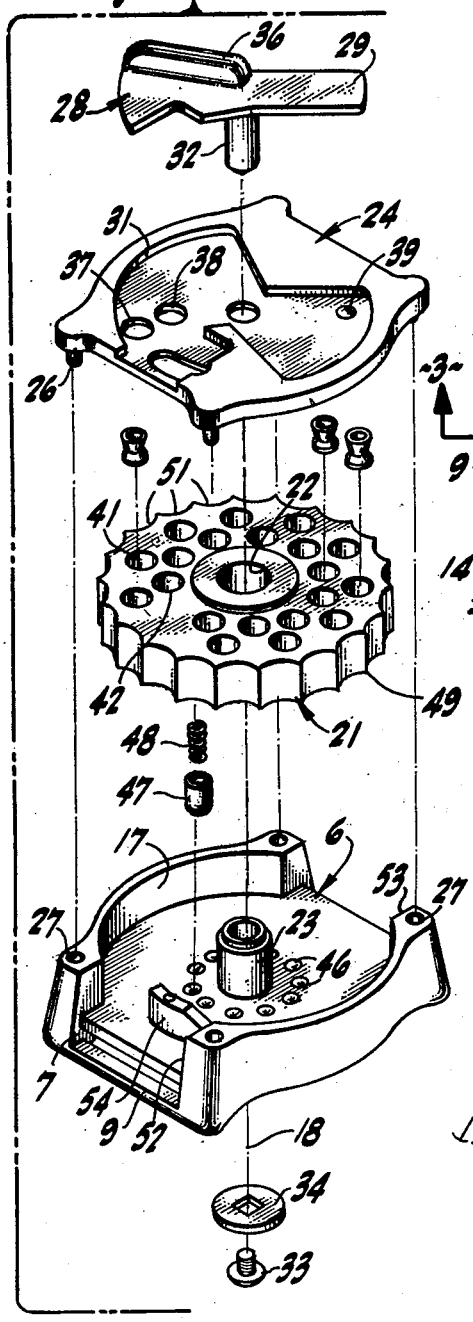
FIG-1
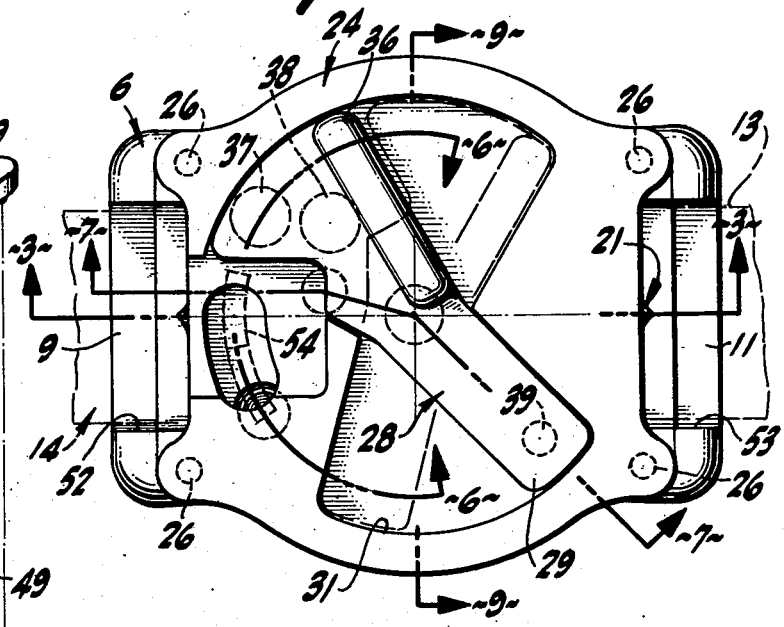
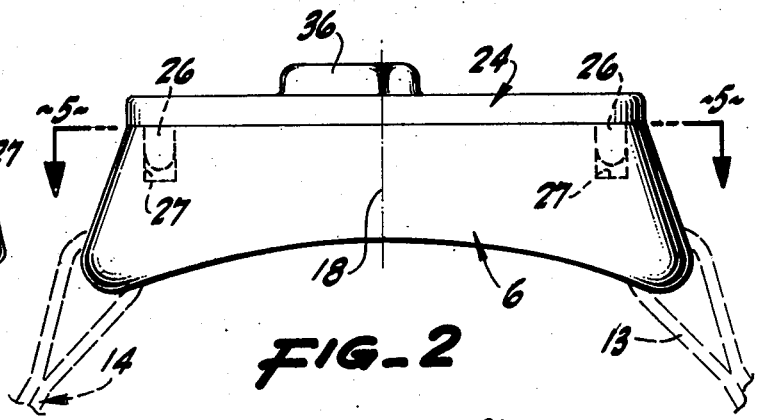
FIG-2
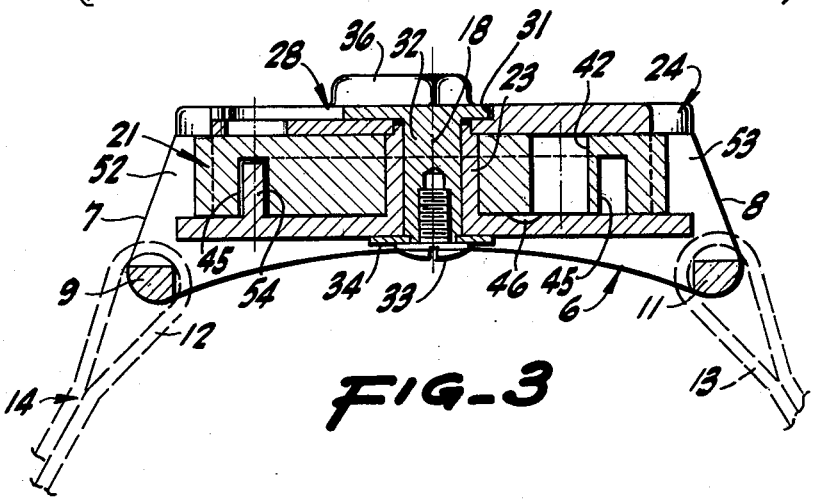
FIG-3

FIG-8
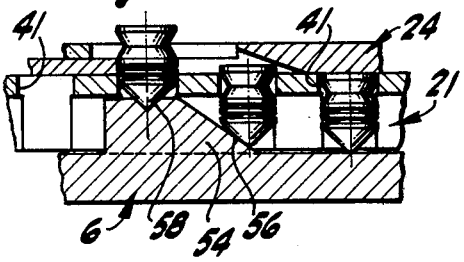
FIG-5
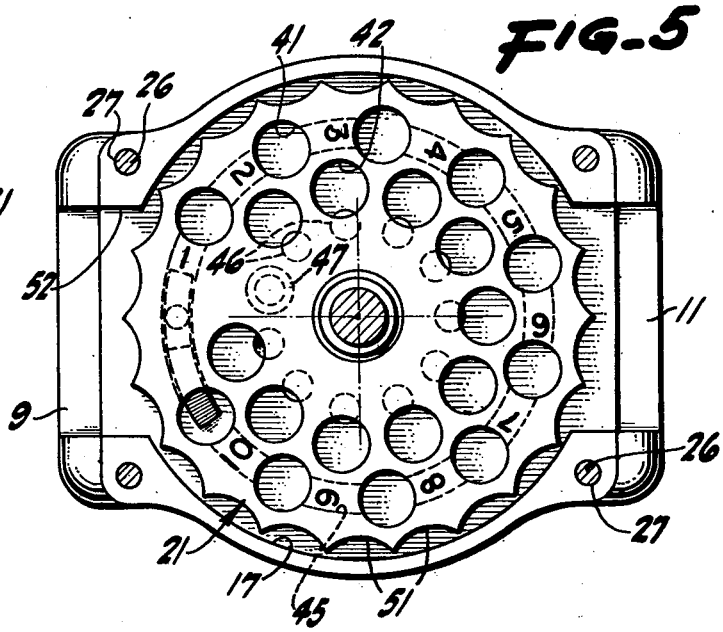
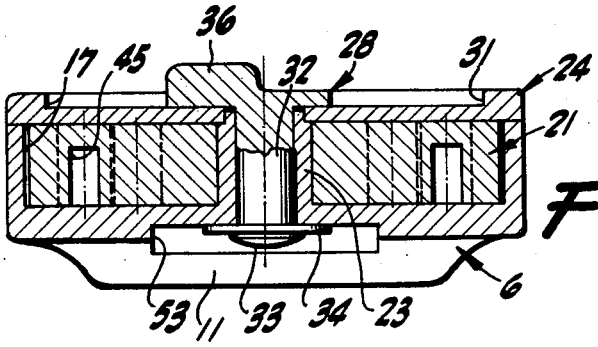
FIG-9
FIG-6
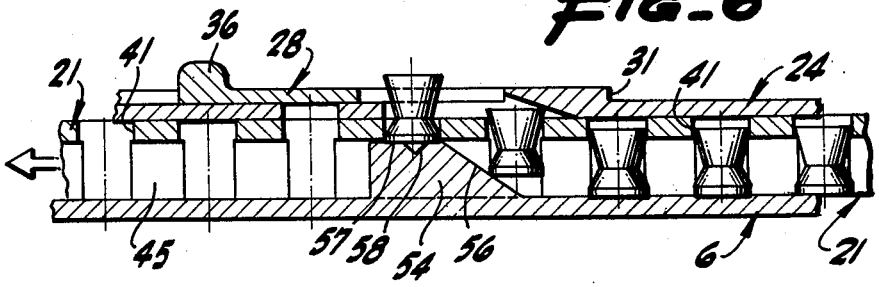
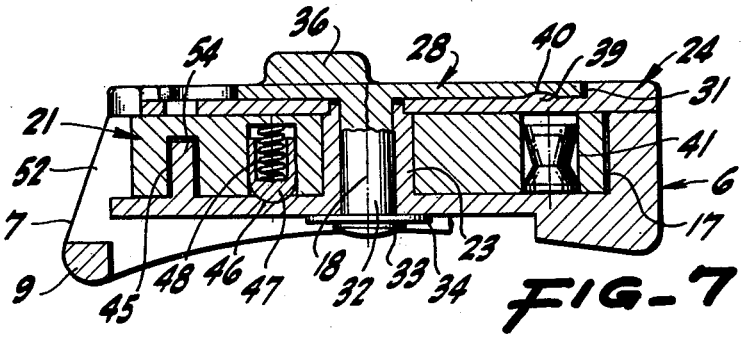
FIG-7

FIG-10
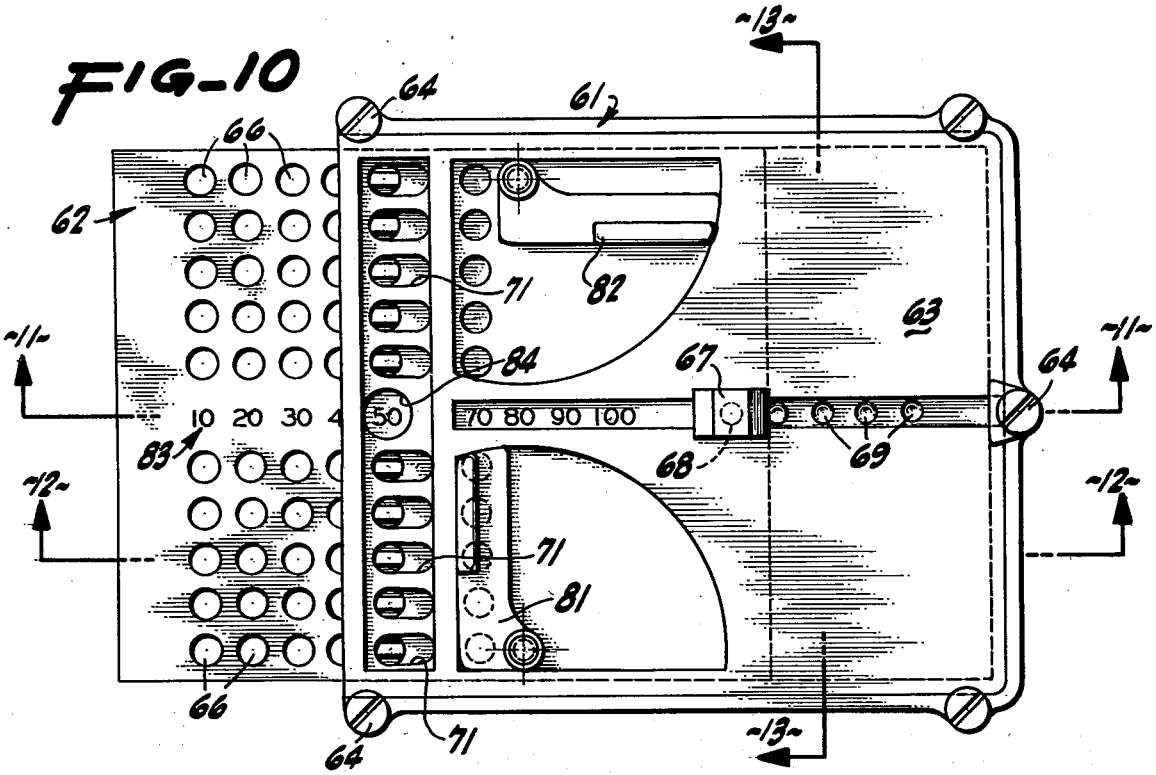
FIG-11
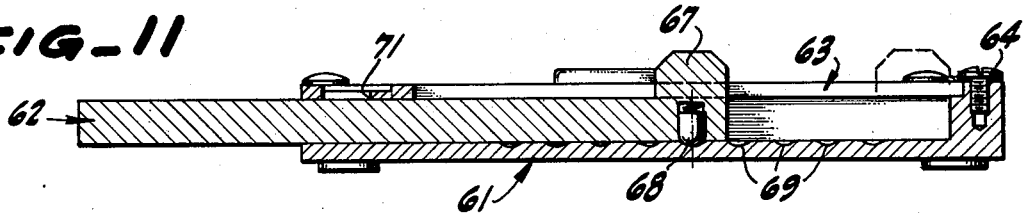
FIG-12
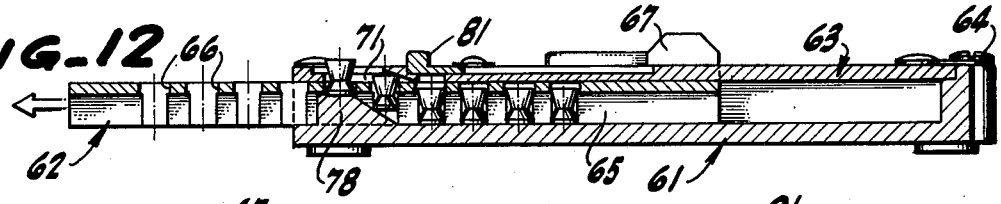
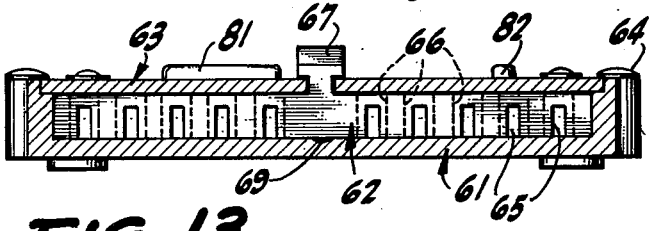
FIG-13
FIG-15
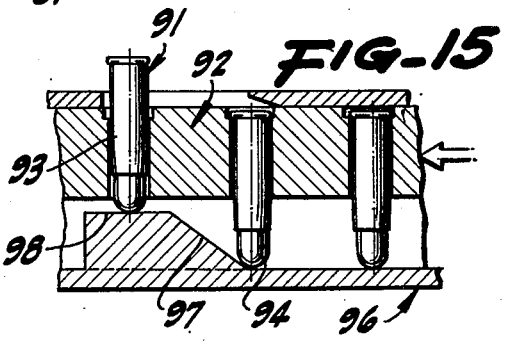
FIG-14
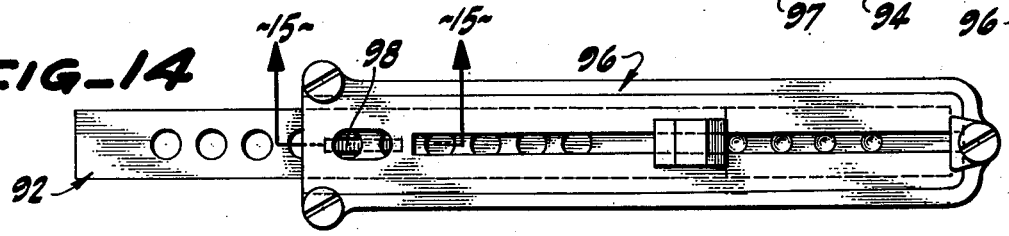

PROJECTILE MAGAZINE

BRIEF SUMMARY OF THE INVENTION

A portable magazine especially for pellets or the like has a base that is readily attached by a strap to either wrist of the user. There is a chamber rotatably mounted within the base and accessible at its edges through cut-away portions in the base adjacent the strap locations. The chamber includes a plurality of projectile storage cells arranged with their axes substantially parallel to each other and to the axis of rotation. Within the base there is a ramp projecting into an annular groove in the rotor and intersecting the cells so that as the rotor is revolved a projectile in an individual storage cell is moved axially up the ramp and partially to project from the device so that the so-projected projectile is readily available for manual removal.

PRIOR ART

No pertinent prior art is known to the applicant at present.

BRIEF DESCRIPTION OF THE SEVERAL VIEWS OF THE DRAWINGS

FIG. 1 is a plan of a structure constructed pursuant to the invention, the connecting straps being shown in phantom.

FIG. 2 is a side elevation of the structure shown in FIG. 1.

FIG. 3 is a cross-section, the plane of which is indicated by the line 3—3 of FIG. 1.

FIG. 4 is an exploded view with individual parts displaced in an axial direction.

FIG. 5 is a cross-section on a horizontal plane, the plane of section being indicated by the line 5—5 of FIG. 2.

FIG. 6 is a cross-section with portions broken away showing a developed view along the line 6—6 of part of the structure of FIG. 1.

FIG. 7 is a cross-section, the planes of which are indicated by the lines 7—7 of FIG. 1.

FIG. 8 is a detailed view in cross-section comparable to FIG. 6, but showing a modified form of structure.

FIG. 9 is a cross-section, the plane of which is indicated by the line 9—9 of FIG. 1.

FIG. 10 is a plan of a modified form of layout utilizing rectilinear translation rather than rotation.

FIG. 11 is a cross-section, the plane of which is indicated by the line 11—11 of FIG. 10.

FIG. 12 is a cross-section, the plane of which is indicated by the line 12—12 of FIG. 10.

FIG. 13 is a cross-section, the plane of which is indicated by the line 13—13 of FIG. 10.

FIG. 14 is a plan of another modified form of rectilinear device.

FIG. 15 is a cross-section, the plane of which is indicated by the line 15—15 of FIG. 14 and being to an enlarged scale and having portions broken away to reduce the size of the figure.

DETAILED DESCRIPTION

In various types of target and game shooting it is necessary to load the shooting piece with ammunition usually in the form of individual shells or pellets. This is normally accomplished by having a loose or random supply of the pellets and then taking them one by one and individually introducing them from time to time into the shooting piece. While this is an effective manner of proceeding, it is not particularly efficient nor easy to accomplish and in some circumstances is a nuisance.

It is therefore an object of the present invention to provide an auxiliary structure effective to harbor and dispense the shells or pellets as required in order to facilitate the loading of the firing piece. For that reason, as especially shown in FIGS. 1 through 9, there is afforded a base 6 or base plate housing preferably comprised of a plastic, rigid material relatively light in density, but strong enough to withstand the requisite duty. The base plate 6 is arcuate and is formed with cut-away ends 7 and 8 spanned by bars 8 and 11. These afford a ready attachment for the looped ends 12 and 13 of a wrist strap 14 of the customary kind. This is usually provided with a fastener of some accepted sort so that the user without difficulty can affix the base 6 on either of his wrists whether he is right- or left-handed. That is, the base 6 is symmetrical, so that either a left-handed or a right-handed user can equally well be accommodated. The base 6 is approximately circular in its plan configuration and defines a central, circular-cylindrical recess 17 symmetrical about a rotary axis 18.

Designed to rotate within the recess is a rotor 21 or drum inclusive of a bearing 22 arranged to be journalled around a hub 23 upstanding from the base. The rotor is secured in place removably by a cover plate 24 generally registering with the base plate 6 and positioned frictionally by lugs 26 lying in recesses 27 in the base. An arcuate swinging gate 28 with a tail 29 moves in a corresponding recess 31 in the cover plate and turns on an axle 32 journalled in a bore in the hub 23, being removably held by a fastener 33 including a squared washer 34 fitting on the axle 32. The gate is movable by a radial finger ridge 36 to move between a guarding position overlying axial openings or bores 37 and 38 in the plate 24 and another position allowing ready access to the openings or bores 37 and 38. The gate is preferably retained in the guarding position by a detent bump 39 impelled by the inherent springiness of the arm to seat in a corresponding recess 40 in the gate 28.

The rotor or drum 21 is formed with an outer series of circular, cylindrical opening or bores 41 each of a size and shape to accommodate one of the intended pellets or shells. The bores are arbitrary in number; for example, ten, and extend parallel to each other generally in a circle and entirely through the outward portion of the rotor 21. One or two bores may readily be omitted. There is an annular groove 45 (FIGS. 3 and 5) intersected by the various bores 41 or openings. Similarly, there is an inner series of bores 42 for accommodating additional pellets or shells. The size and depth of the bores is such that the customary munitions will reside therein without difficulty and with freedom for axial movement for introduction and expulsion.

Means are provided for facilitating the rotary positioning of the rotor or drum 21 particularly from one station to another. For that reason the base plate 6 is provided (FIGS. 4 and 7) with a ring of depressions 46 equally spaced circumferentially and effective to cooperate with a detent pin 47 located in the rotor 21. The pin 47 is impelled by a spring 48 to seat within an adjacent one of the individual depressions so that the rotor tends to stay in any one of the particular indexed positions, but can be rotated therebetween. To facilitate such rotation, the periphery of the rotor is afforded with a roughness 49 preferably in the form of flutes 51 exposed through cut-away portions 52 and 53 in (FIGS. 1 and 4) the base plate 6 adjacent the straps so that the user, by grasping the exposed periphery of the rotor and gripping the serrations, can readily rotate the rotor from one stage to the next.

In order to make the individual munitions immediately available upon the turning of the rotor from stage to stage, the base plate 6 is provided with an ejecting means in the nature of an arcuate ramp 54 lying within the groove 45 and having an inclined portion 56 and a planar top portion 57. In the top portion there is a centering depression 58.

Upon rotation of the rotor or drum 21 relative to the base plate 6, the various pellets are rotated with their respective receptacles. The most advanced pellet is caused to move axially or upwardly with one pellet end, the bottom end, on the ramp incline 56 and then to ride onto the upper, flat portion 57 of the ramp and to lodge in the central depression 58 therein. The other, top end of the individual pellet is thus not only projected for easy grasp, but the pellet is likewise stabilized and centralized in an appropriate location.

The user very readily can utilize his thumb and forefinger, for example, to grasp the projected upper portion of the pellet and remove it from its position within the rotor drum 21 and introduce it into his firing piece.

This same operation is repeated in succession for each one of the several pellets or munitions that are available. When the entire stock, usually ten, has been utilized, then the user can invert the device, thus shaking out those pellets stored temporarily in the inner ring of bores or openings 42 and can then transfer them to and introduce them into the individual receptacles or openings in the outer ring so that he can then repeat the previous performance.

In this way there has been provided a device which can readily be attached by the user to either of his wrists and which, when stocked, affords him a readily available supply of munitions for his shooting. The individual munitions are always at hand, are always properly oriented, and upon partial ejection can readily be grasped by the thumb and forefinger so that they can, with facility, be transferred from the reservoir to the gun.

While the illustrations in FIGS. 1 through 4 inclusive show the device in an uncharged condition, the illustrations in FIGS. 5 through 9 inclusive show the same device, but with the various receptacles or cavities or openings charged with pellets. The pellets in FIGS. 6 and 7, for example, are of one particular standard configuration, whereas those shown in FIG. 8 are of a different standard configuration, but the general operation of the device is the same with either form of pellet. The principal difference is that with the pointed base pellets as shown in FIG. 8 there is provided a recess 59 so that the pellet is stable and well centered when in position for extraction. It is not necessary to have such a recess for the flat-bottom pellets shown in FIG. 6, although a recess of that nature does no harm in the FIG. 6 configuration.

In FIGS. 10 through 13 there is shown a modified form of device in which the case or base plate 61 is generally rectangular and houses a rectangular slide 62 or block, the case having a removable cover 63 held in position by screws 64. In this instance the slide has parallel longitudinal slots 65 intersecting a number of recesses 66 or openings for pellets of the sort already described and has an actuator 67 operating along the center line to move the slide relative to the case. In addition, the slide incorporates a spring-pressed detent 68 designed to cooperate with depressions 69 in the bottom of the case 61 so that the slide can be advanced in equal increments between its extreme positions. As the slide is so advanced, pellets in the various ranks of openings or apertures 66 are moved successively into registry with elongated openings 71 in the cover 63. In so moving, the pellets at one end engage and ride up inclined ramps 78 on the base and within the slots 65 so that the pellets at the other end are expelled from their nested positions to project slightly above the cover and to be exposed for ready manual grasping by the user.

Conveniently, some of the openings in some positions are covered by levers 81 and 82 which can be swung into either extreme position so as to expose the openings beneath them, or to cover such openings, thus facilitating the loading of the structure and precluding the loaded structure from losing its contents. Also, the slide or block 62 conveniently carries indicia 83 at appropriate intervals to afford an immediate indication through a window 84, for example, to the user as to the number of pellets that remain available.

Although reference has generally been made to pellets in the preceding descriptions, it is also equally feasible to utilize ammunition such as shells 91 in the dispensing apparatus. In this instance, the construction is substantially the same as before except that the cover 92 is sufficiently increased in thickness so as to surround the upper portion 93 of the loaded ammunition. The cover allows the bullet 94 at one end of each article of ammunition in to be immediate contact with the base 96 so that the shell can readily rise up the ramp 97 onto the flat, upper portion 98 for presentation of the other end of the shell. This arrangement can be constructed to carry a number of parallel rows of shells, if desired, but also can, as shown in FIG. 14, be arranged with but a single row of shells since some of the shooting practices with this type of ammunition require fewer bullets.

In all of the embodiments of the invention, there is afforded a magazine for orderly positioning of pellets for shooting and for presenting them to the user for ready finger and thumb grasping and in a fashion so the user can wear the device in a position for immediate access.

I claim:

1. A projectile magazine for use with an elongated projectile having two ends comprising a base plate, a drum including a plurality of parallel projectile storage openings extending entirely through said drum, means for movably interrelating said drum and said base plate, and a ramp on said base plate in the path of one end of said projectiles in said storage openings and effective upon relative movement between said base plate and said drum for engaging said one end of said projectiles and at least partially expelling the other end of said projectiles from said openings.

2. A device as in claim 1 in which each of said openings is intersected by a groove having a predetermined transverse dimension and said ramp is in said groove and has a lesser transverse dimension.

3. A device as in claim 1 including means for pivotally mounting said drum on said base plate, a cover, and a pivotal mounting connecting said cover and said base plate for movement of said cover into and out of a position overlying at least some of said openings.

4. A device as in claim 1 including means for interrelating said base plate and said drum for relative rotation about an axis, means defining a concentric annular groove in said drum and intersecting said storage openings, and in which said ramp projects from said base plate into said annular groove and said openings.

5. A projectile magazine for use with an elongated projectile having two ends a predetermined distance apart comprising a base plate, a drum having a number of parallel openings extending through said drum for more than said predetermined distance, means for mounting said drum to turn on said base plate about an axis parallel to said openings, and a ramp on said base plate in position to be engaged by one of said ends as said drum turns on said base plate and to move said projectile in said drum to position the other end of said projectile out of said drum.

6. A projectile magazine as in claim 5 including means defining an annular groove in said drum concentric with said axis and intersecting said openings and partially enclosing said ramp.

7. A projectile magazine as in claim 5 in which said ramp has an upwardly inclined portion and a downwardly inclined portion on opposite sides of a center portion.

* * * * *